US012055367B2

(12) United States Patent
Lee et al.

(10) Patent No.: US 12,055,367 B2
(45) Date of Patent: Aug. 6, 2024

(54) OPTICS MOUNT WITH SLOPE AND TEETH

(71) Applicants: Shanyao Lee, Santa Ana, CA (US); Chien-Yuan Cheng, Santa Ana, CA (US)

(72) Inventors: Shanyao Lee, Santa Ana, CA (US); Chien-Yuan Cheng, Santa Ana, CA (US)

( * ) Notice: Subject to any disclaimer, the term of this patent is extended or adjusted under 35 U.S.C. 154(b) by 0 days.

(21) Appl. No.: 17/500,739

(22) Filed: Oct. 13, 2021

(65) Prior Publication Data

US 2023/0112612 A1 Apr. 13, 2023

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 465,088 A * 12/1891 Patchen ..... F41G 11/007 42/125
2,441,968 A * 5/1948 Henry ..... F41G 1/24 42/137
3,834,035 A * 9/1974 Merrill ..... F41G 1/08 42/133
3,867,764 A * 2/1975 Dunmire ..... F41G 11/003 362/800
4,317,304 A * 3/1982 Bass ..... F41G 11/001 42/125
4,742,636 A * 5/1988 Swan ..... F41G 11/006 42/126
4,756,111 A * 7/1988 Lapier ..... F41G 11/004 42/75.01
5,400,539 A * 3/1995 Moore ..... F41G 11/005 42/126
5,481,818 A * 1/1996 Stover ..... F41G 1/26 42/137
6,073,351 A * 6/2000 Barnett ..... F41G 1/467 42/142
6,332,286 B1 * 12/2001 Shen ..... F41G 3/323 42/120
6,591,538 B2 * 7/2003 Holler ..... F41G 11/007 42/126
6,662,486 B2 * 12/2003 Komberger ..... F41G 11/007 42/138
6,822,791 B2 * 11/2004 Recknagel ..... F41G 11/003 359/405
6,901,692 B2 * 6/2005 Miller ..... F41G 11/003 33/263
7,225,577 B1 * 6/2007 Wang ..... F41G 11/003 42/127

(Continued)

*Primary Examiner* — Michelle Clement
(74) *Attorney, Agent, or Firm* — Ying-Ting Chen; Law Office of Michael Chen

(57) ABSTRACT

A height-adjustable optics mount includes a lower base attachable to the firearm including an angled platform having a plurality of male guiding teeth and located on the lower base; and an upper base which is operable between a slidable position where the upper base is sliding along the plurality of the male guiding teeth and a static position where the upper base is affixed on at least one of the plurality of male guiding teeth.

15 Claims, 5 Drawing Sheets

(56) References Cited

U.S. PATENT DOCUMENTS 7,437,848 B2 * 10/2008 Chang ..... F41G 1/38 42/142
7,647,720 B1 * 1/2010 Vendetti ..... F41G 1/28 42/126
7,765,730 B2 * 8/2010 Keng ..... F41G 11/003 42/141
7,814,698 B2 * 10/2010 Fluhr ..... F41G 1/08 42/111
7,827,724 B1 * 11/2010 Spinelli ..... F41G 11/003 248/295.11
8,151,511 B2 * 4/2012 Gentilini ..... F41G 1/16 42/111
8,156,678 B2 * 4/2012 Hoel ..... F41G 11/003 42/124
8,240,075 B1 * 8/2012 Mullin ..... F41G 11/003 42/122
8,317,025 B1 * 11/2012 Kolozs ..... F42B 39/22 89/1.816
8,528,140 B1 * 9/2013 Phillips ..... F41G 11/003 12/111
8,707,606 B2 * 4/2014 Hoel ..... F41G 11/003 42/124
9,310,163 B2 * 4/2016 Bay ..... F41G 1/473
9,395,156 B2 * 7/2016 Newzella ..... F41G 1/345
9,459,075 B1 * 10/2016 Hatcher ..... F41G 1/48
9,482,516 B2 * 11/2016 McCarthy ..... F41G 3/06
9,574,853 B2 * 2/2017 Crispin ..... F41G 11/007
9,618,302 B2 * 4/2017 Kintzing ..... F41G 1/38
RE46,734 E * 2/2018 Lee ..... F41G 1/30
10,030,939 B2 * 7/2018 Kowalczyk, Jr. ..... F41G 1/35
10,030,940 B2 * 7/2018 Sheets, Jr. ..... F41C 27/00
10,048,040 B1 * 8/2018 Ratliff ..... F41G 11/003
10,060,706 B2 * 8/2018 Jeung ..... F41G 11/003
10,066,903 B2 * 9/2018 Crispin ..... F41G 11/003
10,097,764 B2 * 10/2018 Ehrlich ..... F41G 3/165
RE47,336 E * 4/2019 Lee ..... F41G 1/30
10,254,080 B2 * 4/2019 Jeung ..... F41G 1/473
10,352,658 B1 * 7/2019 Aslin ..... F41G 11/003
10,533,698 B2 * 1/2020 Zhao ..... F16M 11/18
10,563,956 B2 * 2/2020 Kowalczyk, Jr. ..... F41G 1/35
10,591,254 B1 * 3/2020 Kenney ..... F41G 3/08
10,767,960 B2 * 9/2020 Noonan ..... F41G 1/10
10,801,814 B2 * 10/2020 Ma ..... F41G 11/003
11,150,049 B2 * 10/2021 Kennair, Jr. ..... F41G 11/003
11,168,958 B2 * 11/2021 Shimizu ..... F41G 1/38
11,181,338 B2 * 11/2021 Kennair, Jr. ..... F41G 11/003
11,215,426 B1 * 1/2022 Campbell ..... F41G 11/003
2002/0162267 A1 * 11/2002 Nelson ..... F41G 11/003 42/120
2010/0005697 A1 * 1/2010 Fluhr ..... F41G 1/02 42/111
2010/0162611 A1 * 7/2010 Samson ..... F41G 11/003 42/125
2011/0296731 A1 * 12/2011 Carlson ..... F41G 11/001 42/90
2014/0090286 A1 * 4/2014 Kupanoff ..... F41G 11/003 42/127
2014/0252187 A1 * 9/2014 Petrovic ..... F16B 2/185 248/229.16
2014/0305022 A1 * 10/2014 Chung ..... F41G 1/387 42/113
2015/0041538 A1 * 2/2015 Teetzel ..... F41G 3/06 235/404
2016/0238346 A1 * 8/2016 DiCarlo ..... F41G 11/003
2017/0102213 A1 * 4/2017 Bartoszewicz ..... F41G 11/003
2017/0205201 A1 * 7/2017 Sheets, Jr. ..... F41G 11/003
2017/0254615 A1 * 9/2017 Kennair, Jr. ..... F41G 11/003
2017/0299331 A1 * 10/2017 Jozaitis ..... F41F 3/0455
2018/0073839 A1 * 3/2018 Crispin ..... F41G 1/48
2019/0219365 A1 * 7/2019 Ma ..... F41G 11/003
2021/0140740 A1 * 5/2021 Noonan ..... F41G 1/18
2021/0223003 A1 * 7/2021 Morrison ..... F41G 11/003
2021/0389101 A1 * 12/2021 Hughes ..... F41G 11/004
2022/0082349 A1 * 3/2022 McPherson ..... F41B 5/105
2022/0128337 A1 * 4/2022 Campbell ..... F41A 35/00

* cited by examiner

OPTICS MOUNT WITH SLOPE AND TEETH

FIELD OF THE DISCLOSURE

The present disclosure relates to an optics mount, and more particularly to a height-adjustable optics mount having a sloping surface with a plurality of male guiding teeth configured to cooperate with an upper base of the height-adjustable optics mount to affix the upper base at a predetermined height of position.

BACKGROUND OF THE DISCLOSURE

Generally, the conventional optics mount is utilized to secure the optics/gun sights on a firearm. Telescopic and electronic gun sights for use on firearms are well known in the prior art. A traditional method of securing a gun sight to a mount was through the use of at least one ring which encircles the gun sight and a mount which is designed to be secured on the firearm. However, the above-mentioned optics mount only provides the gun sight to be mounted at a fixed height without having a suitable structure to adjust the height of the gun sight.

In some improved prior art example, the mount may provide a means for adjustment which allow for horizontal and vertical adjustment of the gun sight to accommodate lateral and vertical changes in the sight line of the gun sight versus the bore of the host firearm. The improved height-adjustable optics mount includes an upper piece and a lower piece cooperated with the upper piece, wherein the lower piece and the upper piece may be cooperated by a dovetail joint which allows the upper piece to slide along a slope of the lower piece, to adjust a height of the upper piece. Once the height of the upper piece is confirmed, a means for securing may be utilized to affix the upper piece.

However, the slope of the improved prior art example of height-adjustable optics mount comprises a smooth surface, and the upper base may be slid along the smooth surface via the dovetail structure. However, the dovetail structure having the smooth surface may not provide enough friction to support the upper piece being securely mounted at the predetermined height corresponding to the firearm; therefore, the upper piece couldn't be securely affixed on the lower piece due to the recoil power generated during the shooting process.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a height-adjustable optics mount comprises a lower base attachable to the firearm comprising an angled platform having a plurality of male guiding teeth and located on the lower base; and an upper base operable between a slidable position where the upper base is sliding along the plurality of the male guiding teeth and a static position where the upper base is engaged with at least one of the plurality of male guiding teeth.

In another aspect combinable with the general implementation, the angled platform comprises a sloping surface inclinedly arranged with the lower base and affixed on the lower base.

In another aspect combinable with the general implementation, the angled platform comprises a sloping surface defining a right side edge having the plurality of male guiding teeth and a left side edge opposite of the right side edge.

In another aspect combinable with the general implementation, the upper base comprises a female guiding tooth, wherein in the static position, the female guiding tooth is engaged with at least one of the plurality of male guiding teeth.

In another aspect combinable with the general implementation, the angled platform comprises a sloping surface defining a right side edge having the plurality of male guiding teeth, wherein the right side edge is defined on a peripheral edge of the sloping surface.

In another aspect combinable with the general implementation, the upper base comprises a nut having a female guiding tooth and a nut cavity configured to receive the nut.

In another aspect combinable with the general implementation, the upper base comprises a receiving cavity configured to slidably receive the angled platform.

In another aspect combinable with the general implementation, the sloping surface is slidably received within a receiving cavity formed within the upper base.

In another aspect combinable with the general implementation, the upper base further comprises a means for engaging with the nut to affix the nut on the upper base.

In another aspect combinable with the general implementation, the right side edge is parallel to the left side edge.

In another aspect combinable with the general implementation, the upper base comprises a female guiding tooth, wherein in the slidable position, the female guiding tooth is released from the male guiding teeth.

In another aspect combinable with the general implementation, the upper base comprises a female guiding tooth located inside a receiving cavity formed on a bottom side of the upper base.

In another aspect combinable with the general implementation, the lower base comprises a bottom surface attachable to the firearm and a top surface where the angled platform is affixed thereon, wherein the bottom surface is opposite of the top surface.

In another aspect combinable with the general implementation, the plurality of the male guiding teeth comprises a plurality of locking grooves configured to engage with the female guiding tooth, wherein each of the locking grooves is spacedly arranged with one another in a row.

Another aspect of the embodiment is directed to methods of securing an upper base of a height-adjustable optics mount at a predetermined height with a firearm where the height-adjustable optics mount is mounted thereon.

In another aspect combinable with the general implementation, the method may include an affixing step of affixing the upper base on at least one of the plurality of male guiding teeth formed on the angled platform of the lower base.

In another aspect combinable with the general implementation, the method may include a sliding step of sliding the upper base along with an angled platform of a lower base having a plurality of male guiding teeth of the height-adjustable optics mount.

In another aspect combinable with the general implementation, the method may include an engaging step of engaging a female guiding tooth formed on the upper base with one of the plurality of male guiding teeth to secure the upper base at the predetermined height with the firearm; and a releasing step of releasing the female guiding tooth from the one of the plurality of male guiding teeth to allow the female guiding tooth sliding along the angled platform.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

A "peripheral edge", as used herein, refers to the external boundary of a sloping surface of the invention.

Figure 1:
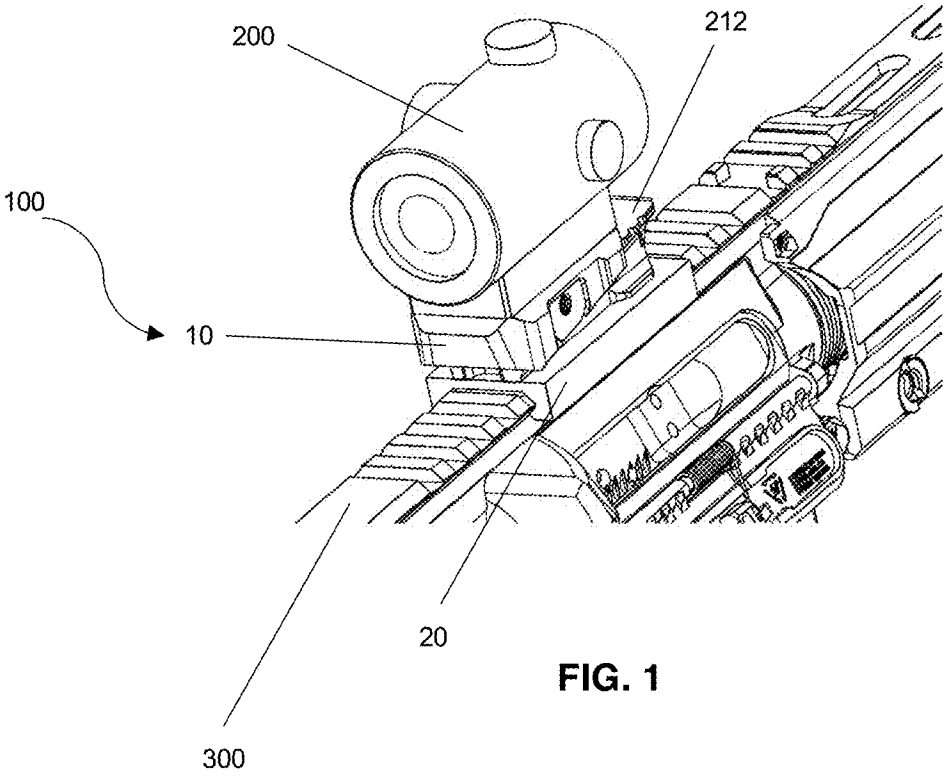
FIG. 1 is a perspective view of a height-adjustable optics mount according to an aspect of the embodiment.

FIG. 1 generally depicts a height-adjustable optics mount 100 cooperated with a gun sight 200 and attached to a firearm 300.

Referring to FIG. 1, the height-adjustable optics mount 100 comprises a lower base 20 attached to the firearm 300 and an upper base 10 configured to cooperate with the lower base 20.

In some embodiments, the gun sight 200 may be mounted on the upper base 10 to support the gun sight 200 on the firearm 300, and in such a manner, the upper base 10 may be laterally and vertically sliding on the lower base 20 to adjust a height of the gun sight 200 mounted on the firearm 300.

Figure 2:
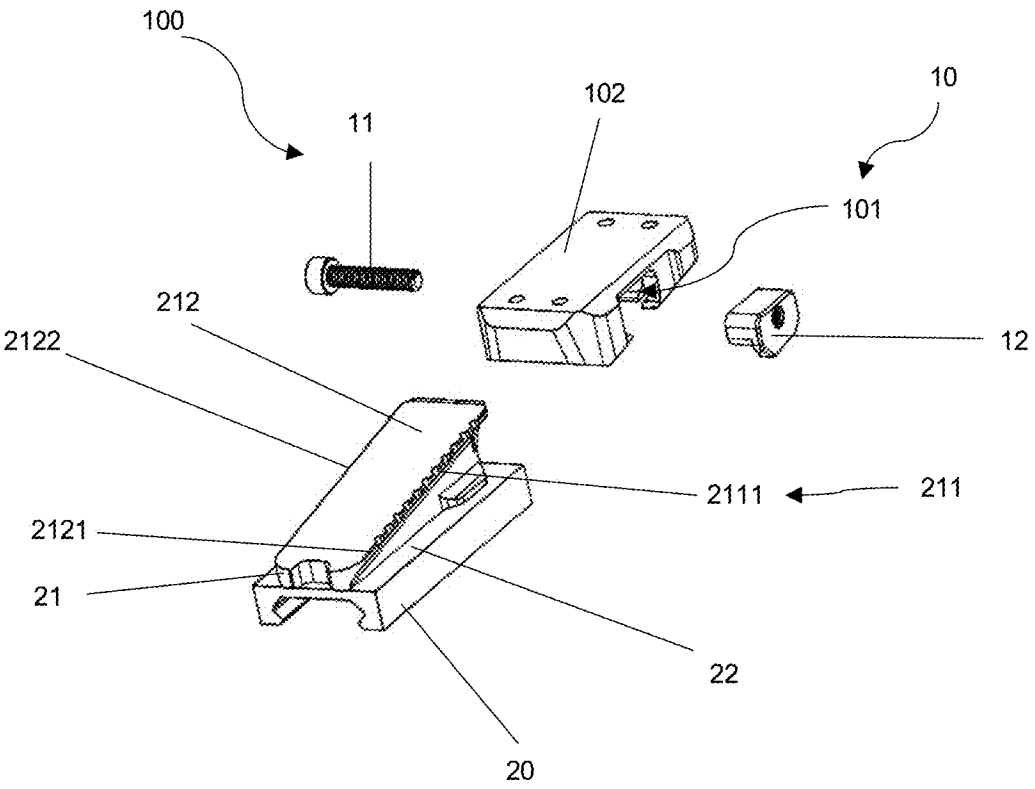
FIG. 2 is an exploded view of the height-adjustable optics mount according to an aspect of the embodiment.

FIG. 2 generally depicts an exploded view of the height-adjustable optics mount 100 according to an aspect of the embodiment.

Referring to FIG. 2, the lower base 20 comprises an angled platform 21 having a plurality of male guiding teeth 211, wherein the angled platform 21 may be affixed/located on the lower base 20.

In some embodiments, the lower base 20 comprises a bottom surface attachable to the firearm (as shown in FIG. 1) and a top surface 22 where the angled platform 21 may be located thereon, wherein the bottom surface is opposite of the top surface 22.

In some embodiments, the angled platform 21 comprises a sloping surface 212 defining a right side edge 2121 and a left side edge 2122 opposite of the right side edge 2121, wherein the right side edge 2121 may be parallel to the left side edge 2122. The angled platform 21 further comprises a front side edge and a rear side edge opposite of the front side edge, wherein the front side edge and the rear side edge may be located between the right side edge 2121 and the left side edge 2122.

In some embodiments, a length of the right side edge 2121 may be the same as a length of the left side edge 2122, and a length of the right side edge 2121 and a length of the left side edge 2122 may be shorter than lengths of the front side edge and the rear side edge.

In some embodiments, the right side edge 2121 may be defined by a peripheral edge of the sloping surface 212. In other words, the peripheral edge of the sloping surface 212 may be defined by the right side edge 2121, the left side edge 2122, the front side edge, and the rear side edge.

In some embodiments, the sloping surface 212 may be inclinedly arranged with the top surface 22 of the lower base 20, wherein the sloping surface 212 may be inclinedly arranged with the top surface 22 of the lower base 20 at a predetermined angle. For example, the predetermined angle may be less than 90 degrees.

In some embodiments, an area of the sloping surface 212 may be less than an area of the top surface 22 of the lower base 20 and an area of the bottom surface of the lower base 20. In some embodiments, the area of the sloping surface 212 may be equal to the area of the top surface 22 of the lower base 20 and the area of the bottom surface of the lower base 20. In some embodiments, the area of the sloping surface 212 may be greater than the area of the top surface 22 of the lower base 20 and the area of the bottom surface of the lower base 20.

In some embodiments, the right side edge 2121 of the sloping surface 212 may comprise a plurality of male guiding teeth 211, wherein the plurality of male guiding teeth 211 may arrange along and all over the right side edge 2121.

In some embodiments, the plurality of the male guiding teeth 211 may comprise a plurality of locking grooves 2111 spacedly arranged on the right side edge 2121 of the sloping surface 212, wherein each of the locking grooves 2111 may be spacedly arranged with one another along the right side edge 2121. In some embodiments, the plurality of locking grooves 2111 may be spacedly arranged to form at least one row. In some embodiments, each of the plurality of locking grooves 2111 may be arranged side by side. For example, each of the locking grooves 2111 may be spacedly arranged with one another at an equal distance.

In some embodiments, the plurality of the male guiding teeth 211 may comprise the plurality of locking grooves 2111 spacedly arranged on the right side edge 2121. For example, each of the plurality of the locking grooves 2111 may be located at a different distance with the top surface 22 of the lower base 20. The distance may be a distance between the top surface 22 of the lower base 20 and one of the plurality of the locking grooves 2111.

In some embodiments, each of the locking grooves 2111 may be inwardly extended from the right side edge 2121 of the sloping surface 212, wherein the plurality of the locking grooves 2111 may be arranged all over the right side edge 2121.

Continuing to FIG. 1 and FIG. 2, the upper base 10 may be operable between a slidable position and a static position, wherein in the slidable position, the upper base 10 may be slid along the right side edge 2121 of the sloping surface 212. In other words, the upper base 10 may be longitudinally and vertically sliding with the lower base 20 to adjust the height of the upper base 10 corresponding to the firearm.

In some embodiments, in the static position, the upper base 10 may be affixed on at least one of the plurality of male guiding teeth 211. In other words, the upper base 10 may be affixed on the lower base 20, and in a known manner, the upper base 10 may be affixed at the predetermined height corresponding to the firearm.

It should be understood that the above-described location of the male guiding teeth 211 is exemplary and the male guiding teeth 211 may be formed on any position of the lower base 20 which can be adopted in various embodiments of this disclosure.

Figure 3:
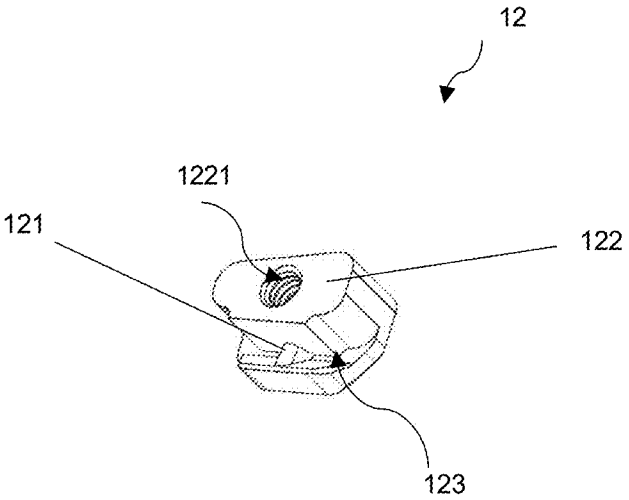
FIG. 3 is a nut of the height-adjustable optics mount according to an aspect of the embodiment.

FIG. 3 generally depicts a female guiding tooth 121 located on the upper base of the height-adjustable optics mount according to an aspect of the embodiments.

Referring to FIG. 3, the upper base comprises a nut 12 having the female guiding tooth 121 configured to selectively engage with at least one of the locking grooves 2111 of the male guiding teeth 211, as shown in FIG. 2.

In some embodiments, the nut 12 comprises a protrusion 122 and the female guiding tooth 121 arranged adjacent to the protrusion 122. The nut 12 may further comprise a guiding wall integrally extended from the protrusion 122 and a receiving slot 123 formed between the guiding wall and the protrusion 122, wherein the female guiding tooth 121 may locate within the receiving slot 123.

In some embodiments, with specific reference to FIGS. 2-3, the protrusion 122 comprises a locking hole 1221 formed inside the protrusion 122 and configured to engage with a screw 11 for securing the nut 12 within the upper base 10. The upper base 10 comprises a nut cavity 101 configured to receive the nut 12. For example, the nut 12 may be received inside the nut cavity 101 formed within the upper base 10, and the screw 11 may be engaged with the locking hole 1221 of the protrusion 122, and in such a manner, the nut 12 may be secured within the nut cavity 101 through the screw 11.

Continuing to FIGS. 2-3, the upper base 10 may be operable between a slidable position and a static position, wherein in the slidable position, the female guiding tooth 121 may be slid along the right side edge 2121 without engaging with the locking groove 2111 of the male guiding teeth 211. In some embodiments, the guiding wall may be sliding along the right side edge 2121 having the plurality of the male guiding teeth 211. In other words, the upper base 10 may be longitudinally and vertically sliding with the lower base 20 to adjust the height of the upper base 10 corresponding to the firearm.

In some embodiments, in the static position, the female guiding tooth 121 may be engaged with at least one of the plurality of male guiding teeth 211, and in such a way, the male guiding teeth 211 may be received within the receiving slot 123 with the female guiding tooth 121 being engaging with the locking groove 2111 of the male guiding teeth 211. In other words, the upper base 10 may be affixed on the lower base 20, and in a known manner, the upper base 10 may be affixed at the predetermined height corresponding to the firearm.

In some embodiments, each of the plurality of the male guiding teeth 211 comprises a locking groove 2111 configured to engage with the female guiding tooth 121 to affix the upper base 10 on the angled platform 21 of the lower base 20.

In some embodiments, the plurality of the locking grooves 2111 may be arranged all over the right side edge 2121, and the female guiding tooth 121 may be selectively engaged with any one of the plurality of the locking grooves 2111 to secure the upper base 10 at the predetermined height.

The predetermined height may be a distance between an upper side 102 of the upper base 10 and the top surface 22 of the lower base 20.

Figure 4:
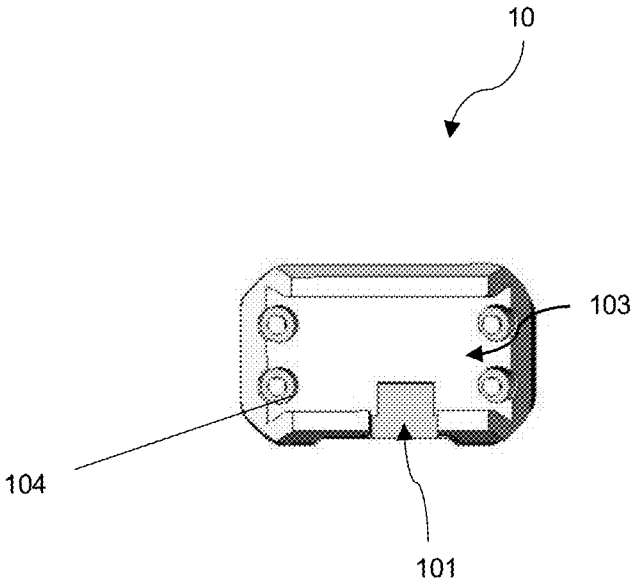
FIG. 4 is a bottom view of an upper base of the height-adjustable optics mount according to an aspect of the embodiment.

FIG. 4 generally depicts the upper base 10 of the height-adjustable optics mount according to an aspect of the embodiments.

In some embodiments, the upper base 10 comprises a receiving cavity 103 formed on a bottom side 104 of the upper base 10 and the bottom side 104 may be configured to slidably receive the angled platform 21. The upper base 10 further comprises the upper side 102 opposite of the bottom side 104 and the upper side 102 may be attachable to the optics, as shown in FIG. 2.

In some embodiments, the nut cavity 101 may be located on the bottom side 104 of the upper base 10, wherein the nut 12 may be received inside the nut cavity 101 and engaged with the screw 11 to couple the nut 12 with the upper base 10, as shown in FIGS. 2-4.

Referring to the details of FIGS. 2-4, the sloping surface 212 of the angled platform 21 may be slidably received within the receiving cavity 103 formed on the bottom side 104 of the upper base 10.

In some embodiments, in the slidable position, the sloping surface 212 of the angled platform 21 may be sliding along the receiving cavity 103 formed on the bottom side 104 of the upper base 10, and in this way, the female guiding tooth 121 may be released from the locking groove 2111 of the male guiding teeth 211.

In some embodiments, the female guiding tooth 121 may be located inside the receiving cavity 103 formed on the bottom side 104 of the upper base 10.

Figure 5:
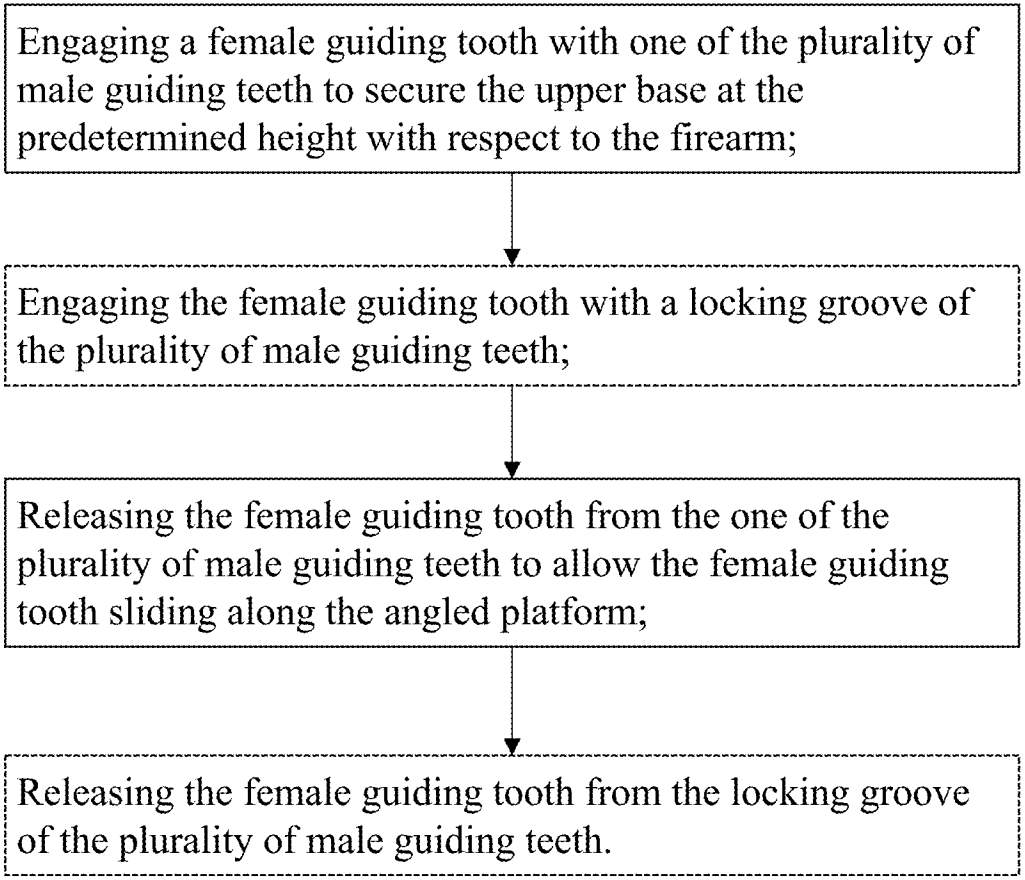
FIG. 5 is a method for adjusting a height of an upper base of the height-adjustable optics mount according to an aspect of the embodiment.

FIG. 5 generally depicts a method for securing an upper base 10 of a height-adjustable optics mount 100 at a predetermined height with a firearm 300 where the height-adjustable optics mount 100 is mounted thereon.

Referring to FIG. 5, the method may include a sliding step of sliding the upper base 10 along an angled platform 21 of a lower base 20 having a plurality of male guiding teeth 211 of the height-adjustable optics mount 100.

In some embodiments, the method may further comprise an affixing step of affixing the upper base on at least one of the plurality of male guiding teeth 211 formed on the angled platform 21 of the lower base 20.

In some embodiments, the method may further comprise an engaging step of engaging a female guiding tooth 121 formed on the upper base 10 with one of the plurality of male guiding teeth 211 to secure the upper base 10 at the predetermined height with the firearm 300; and a releasing step of releasing the female guiding tooth 121 from the one of the plurality of male guiding teeth 211 to allow the female guiding tooth 121 sliding along the angled platform 21.

In some embodiments, the male guiding teeth 211 may be located along a right side edge 2121 of a sloping surface 212 formed on the angled platform 21.

In some embodiments, the engaging step further comprises a step of engaging the female guiding tooth 121 with a locking groove 2111 of the plurality of male guiding teeth 211.

In some embodiments, the releasing step further comprises a step of releasing the female guiding tooth 121 from the locking groove 2111 of the plurality of male guiding teeth 211.

Similarly, while operations and/or methods may be depicted in the drawings in a particular order, this should not be understood as requiring that such operations be performed in the particular order shown or in sequential order, or that all illustrated operations and/or method steps be performed, to achieve desirable results. In certain circumstances, multitasking and parallel processing may be advantageous.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of height-adjustable optics mount with slope and tooth have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A height-adjustable optics mount, comprising:

a lower base attachable to the firearm comprising an angled platform having a plurality of male guiding teeth and located on the lower base; and an upper base which is operable between a slidable position where the upper base is sliding along the plurality of the male guiding teeth, and a static position where the upper base is affixed on at least one of the plurality of male guiding teeth, wherein the upper base comprises a nut having a female guiding tooth, and in the static position, the female guiding tooth is engaged with at least one of the plurality of male guiding teeth, and the height of the optics mount is determined by the engaged position of the female guiding tooth and said at least one of the plurality of male guiding teeth; said engaged position is changed by directly sliding the upper base along the plurality of the male guiding teeth, and the upper base slides along a longitudinal axis and the female guiding tooth slides perpendicular to the longitudinal axis.

2. The height-adjustable optics mount of claim 1, wherein the angled platform comprises a sloping surface inclinedly arranged with the lower base and affixed on the lower base.

3. The height-adjustable optics mount of claim 1, wherein the angled platform comprises a sloping surface defining a right side edge having the plurality of male guiding teeth and a left side edge opposite of the right side edge.

4. The height-adjustable optics mount of claim 1, wherein the upper base comprises a receiving slot where the female guiding tooth is located therein, and in the slidable position, a right side edge of a sloping surface of the angled platform is sliding along the receiving slot.

5. The height-adjustable optics mount of claim 1, wherein the angled platform comprises a sloping surface defining a right side edge having the plurality of male guiding teeth, wherein the right side edge is defined on a peripheral edge of the sloping surface.

6. The height-adjustable optics mount of claim 1, wherein the upper base comprises a nut cavity configured to receive the nut.

7. The height-adjustable optics mount of claim 1, wherein the upper base comprises a receiving cavity formed on a bottom side of the upper base and configured to slidably receive the angled platform.

8. The height-adjustable optics mount of claim 5, wherein the sloping surface is slidably received within a receiving cavity formed on a bottom side of the upper base.

9. The height-adjustable optics mount of claim 6, wherein the upper base further comprises a means for engaging with the nut to affix the nut on the upper base.

10. The height-adjustable optics mount of claim 3, wherein the right side edge is parallel to the left side edge.

11. The height-adjustable optics mount of claim 1, wherein the upper base comprises a female guiding tooth, and when in the slidable position, the female guiding tooth is released from the male guiding teeth.

12. The height-adjustable optics mount of claim 1, wherein the upper base comprises a female guiding tooth located inside a receiving cavity formed on a bottom side of the upper base.

13. The height-adjustable optics mount of claim 1, wherein the lower base comprises a bottom surface attachable to the firearm and a top surface where the angled platform is located thereon, wherein the bottom surface is opposite of the top surface.

14. The height-adjustable optics mount of claim 1, wherein the plurality of the male guiding teeth comprises a plurality of locking grooves, and each of the locking grooves is spacedly arranged with one another in a row.

15. The height-adjustable optics mount of claim 1, wherein the upper base comprises a female guiding tooth, and when in the static position, the female guiding tooth is engaged with a plurality of locking grooves of the male guiding grooves.

* * * * *